US009254005B2

(12) United States Patent
Liu

(10) Patent No.: US 9,254,005 B2
(45) Date of Patent: Feb. 9, 2016

(54) ELECTRONIC CIGARETTE CASE

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD. SHENZHEN BRANCH, Shenzhen (CN)

( * ) Notice: Subject to any disclaimer, the term of this patent is extended or adjusted under 35 U.S.C. 154(b) by 182 days.

(21) Appl. No.: 13/958,215

(22) Filed: Aug. 2, 2013

(65) Prior Publication Data

US 2015/0008149 A1 Jan. 8, 2015

(30) Foreign Application Priority Data

Jul. 8, 2013 (CN) ..... 2013 2 0403626 U

(51) Int. Cl.
*A24F 15/00* (2006.01)
*A24F 15/20* (2006.01)
*A24F 47/00* (2006.01)

(52) U.S. Cl.
CPC ..... *A24F 15/20* (2013.01); *A24F 47/008* (2013.01)

(58) Field of Classification Search
CPC ..... A24F 15/00; A24F 15/20; A24F 15/12; A24F 15/18; A24F 13/08
USPC ..... 206/257
See application file for complete search history.

(56) References Cited

U.S. PATENT DOCUMENTS 4,183,433 A * 1/1980 Kroner ..... 206/257
4,207,976 A * 6/1980 Herman ..... 206/246
4,342,902 A * 8/1982 Ping ..... 219/268
4,793,478 A * 12/1988 Tudor ..... 206/256
5,005,710 A * 4/1991 Hofer ..... 211/70.6
5,433,318 A * 7/1995 Focke ..... 206/256
5,476,171 A * 12/1995 Minarelli et al. ..... 206/256
5,810,164 A * 9/1998 Rennecamp ..... 206/256
5,938,017 A * 8/1999 Wik ..... 206/256
D449,404 S * 10/2001 Emery ..... D27/186
6,321,757 B1 * 11/2001 McCutcheon ..... 131/235.1
6,446,793 B1 * 9/2002 Layshock ..... 206/86
6,474,342 B1 * 11/2002 Rennecamp ..... 131/241
6,651,809 B2 * 11/2003 Holler ..... 206/213.1
6,840,372 B2 * 1/2005 Giles et al. ..... 206/216
6,978,890 B2 * 12/2005 Pangerc et al. ..... 206/349
2004/0103907 A1 * 6/2004 Collett et al. ..... 131/235.1
2005/0236282 A1 * 10/2005 Huska ..... 206/246
2007/0034216 A1 * 2/2007 Liu et al. ..... 131/256
2013/0140200 A1 * 6/2013 Scatterday ..... 206/265
2013/0336358 A1 * 12/2013 Liu ..... 374/152
2013/0341218 A1 * 12/2013 Liu ..... 206/242

(Continued)

*Primary Examiner* — Anthony Stashick
*Assistant Examiner* — Ernesto Grano
(74) *Attorney, Agent, or Firm* — Tim Tingkang Xia, Esq.; Locke Lord LLP

(57) ABSTRACT

An electronic cigarette case is provided, and comprises a bracket configured to accommodate an electronic cigarette; the electronic cigarette case further comprises an elastic soft block mounted on the bracket and configured for holding the electronic cigarette. By implementing the electronic cigarette case in the present invention, the following advantages can be achieved. The electronic cigarette case adopts the elastic soft block to hold electronic cigarettes, so that the electronic cigarettes can be accommodated in the electronic cigarette case firmly and prevented from loosening. Furthermore, since the structure of the elastic soft blocks is made of soft rubber or foam, which has good elasticity and low hardness, the electronic cigarettes can be avoided from being scratched effectively.

10 Claims, 5 Drawing Sheets

(56) References Cited

U.S. PATENT DOCUMENTS

2013/0342157 A1* 12/2013 Liu ..... 320/107
2014/0007892 A1* 1/2014 Liu ..... 131/329
2014/0020697 A1* 1/2014 Liu ..... 131/329
2014/0130816 A1* 5/2014 Liu ..... 131/329

* cited by examiner

ELECTRONIC CIGARETTE CASE

CROSS-REFERENCE TO RELATED APPLICATIONS

This non-provisional application claims priorities under 35 U.S.C. §119(a) on Patent Application No. 201320403626.8 filed in P.R. China on Jul. 8, 2013, the entire contents of which are hereby incorporated by reference.

FIELD OF THE INVENTION

The present invention relates to the field of consumer electronic products, and more particularly, relates to an electronic cigarette case.

BACKGROUND OF THE INVENTION

Electronic cigarette cases are configured to store electronic cigarettes. An electronic cigarette case in the prior art includes a bracket configured for accommodating electronic cigarettes, and the bracket is usually made of plastic. Because the bracket generally has high hardness, if the bracket fixes the electronic cigarettes firmly, the electronic cigarettes may be scratched when they are taken out of or put into the electronic case. However, if the bracket does not fix the electronic cigarette firmly, the electronic cigarettes accommodated in the electronic cigarette case may get loose, and thus the electronic cigarettes may be damaged.

SUMMARY OF THE INVENTION

The objective of the present invention is to provide an electronic cigarette case that can prevent electronic cigarettes from being damaged when the electronic cigarette are taken out of or put into electronic cigarette cases, aiming at the defect that electronic cigarettes accommodated in an electronic cigarette case in the prior art are likely to be damaged.

The technical solutions of the present invention for solving the technical problems are as follows:

An electronic cigarette case is provided, and comprises a bracket configured to accommodate an electronic cigarette; the electronic cigarette case further comprises an elastic soft block mounted on the bracket and configured for holding the electronic cigarette.

Advantageously, the elastic soft block defines a plurality of holding holes configured to hold the electronic cigarettes.

Advantageously, the elastic soft block includes at least one protruding resisting part formed on a portion of a surface of the elastic soft block inside the holding hole, and the resisting part and the electronic cigarette resist each other.

Advantageously, the number of the resisting parts provided is four, and the four resisting parts are uniformly strewn on the portion of the surface of the elastic soft block inside the holding hole.

Advantageously, the resisting part extends from one end of the holding hole to another end of the holding hole along an axis of the holding hole.

Advantageously, the elastic soft block is made of soft rubber or foam.

Advantageously, the bracket defines a plurality of accommodating holes configured to accommodate the electronic cigarette.

Advantageously, the accommodating holes are configured to correspond to the holding holes, and each of the accommodating holes is coaxial with a corresponding one of the holding holes.

Advantageously, the bracket defines a mounting recess matching the elastic soft block, and the elastic soft block is mounted inside the mounting recess.

Advantageously, the elastic soft block further includes a protruding fool-proofing portion formed on a side surface of the elastic soft block, and a fool-proofing groove matching the fool-proofing portion is defined on an inner side wall of the mounting recess.

Advantageously, a first fastener is formed on a side surface of the elastic soft block abutting the mounting recess, and a first fastening slot is formed in the mounting recess and configured to fasten the first fastener.

Advantageously, a second fastening slot is formed on a side surface of the elastic soft block abutting the mounting recess, and a second fastener is formed in the mounting recess and configured to be fastened by the second fastening slot.

Advantageously, an adhesive layer is positioned between the elastic soft block and the mounting recess.

Advantageously, the elastic soft block is integrated with the bracket.

Advantageously, the electronic cigarette case further includes a first case body and a second case body connected with the first case body; and the bracket is mounted inside space formed by the first case body and the second case body.

Advantageously, the first case body is connected with the second case body by hinging.

By implementing the electronic cigarette case in the present invention, the following advantages can be achieved. The electronic cigarette case adopts the elastic soft block to hold electronic cigarettes, so that the electronic cigarettes can be accommodated in the electronic cigarette case firmly and prevented from loosening. Furthermore, since the structure of the elastic soft blocks is made of soft rubber or foam, which has good elasticity and low hardness, the electronic cigarettes can be avoided from being scratched effectively.

BRIEF DESCRIPTION OF THE DRAWINGS

The present invention will be further described with reference to the accompanying drawings and embodiments in the following, in the accompanying drawings.

DETAILED DESCRIPTION OF THE PREFERRED EMBODIMENT

To make the technical feature, objective and effect of the present invention be understood more clearly, now the specific implementation of the present invention is described in detail with reference to the accompanying drawings and embodiments.

Figure 1:
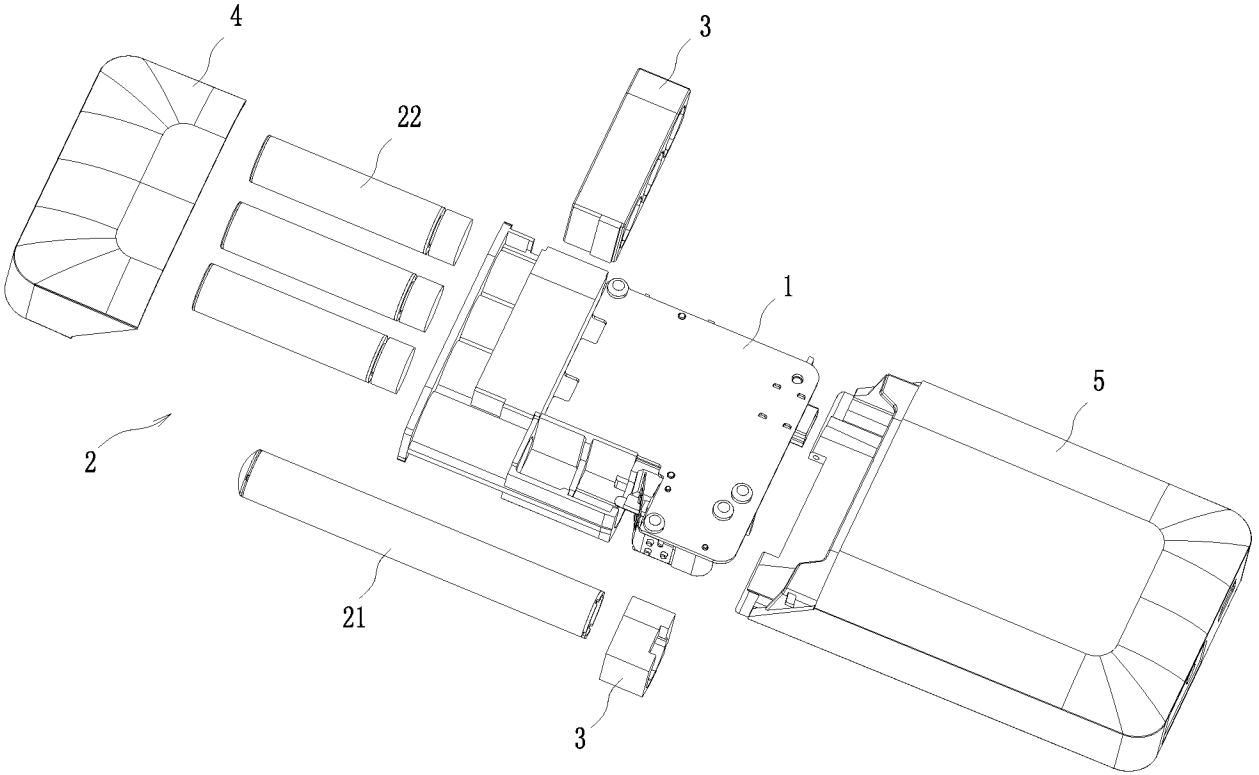
FIG. 1 is an exploded view of an electronic cigarette case of a preferred embodiment of the present invention.
Figure 2:
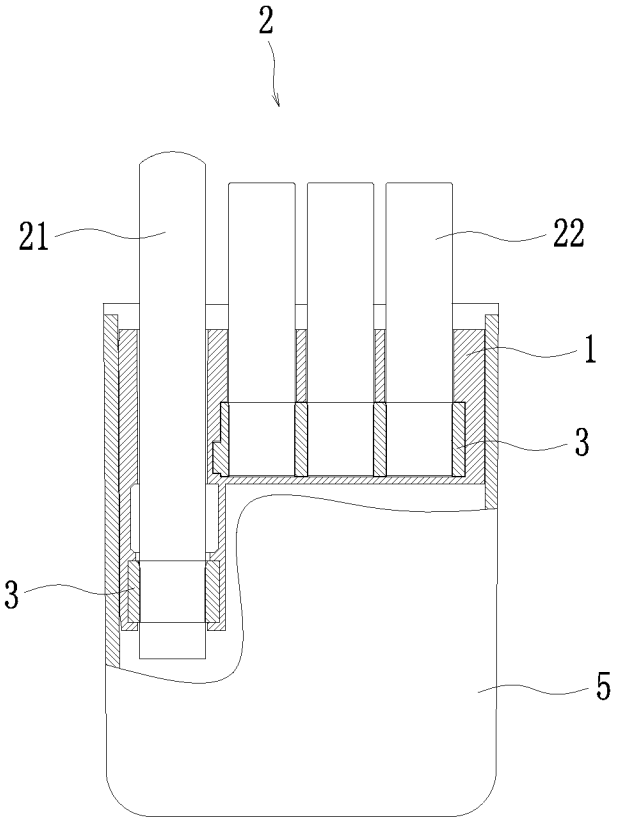
FIG. 2 is a schematic partial cut-away view of the electronic cigarette case shown in FIG. 1.

As shown in FIG. 1 and FIG. 2, a preferred embodiment of the present invention provides an electronic cigarette case, which comprises a bracket 1 and at least one elastic soft block 3. The bracket 1 is configured to accommodate at least one electronic cigarette 2. The number of the electronic cigarettes 2 accommodated in the bracket 1 is schematically shown in the drawings. It is understood that the bracket 1 can be designed according to the number of the electronic cigarettes 2. The elastic soft block 3 is substantially a block structure, and has low hardness and good elasticity. The elastic soft block 3 is mounted on the bracket 1 and configured to hold the electronic cigarettes 2. The electronic cigarette case adopts the structure of the elastic soft block 3 to hold the electronic cigarettes 2, which enables the electronic cigarettes 2 to be held in the electronic cigarette case firmly and prevented from getting loose. Furthermore, since the elastic soft block has good elasticity and low hardness, the electronic cigarettes 2 can be avoided from being scratched effectively.

Figure 4:
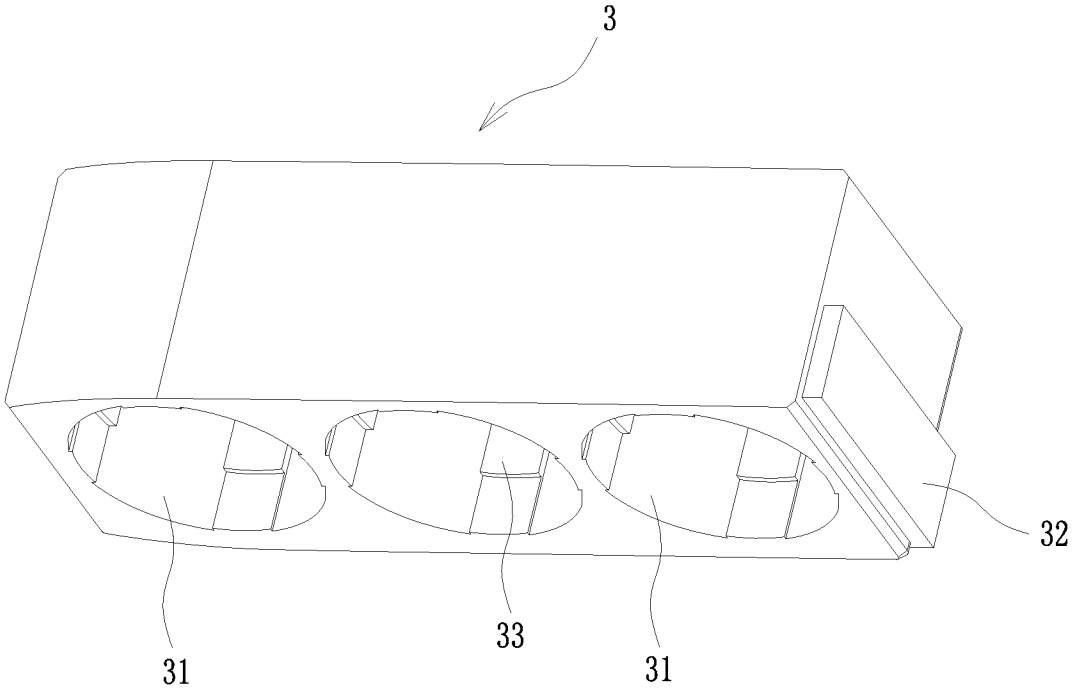
FIG. 4 is a schematic perspective view of an elastic soft block of the electronic cigarette case shown in FIG. 1.
Figure 5:
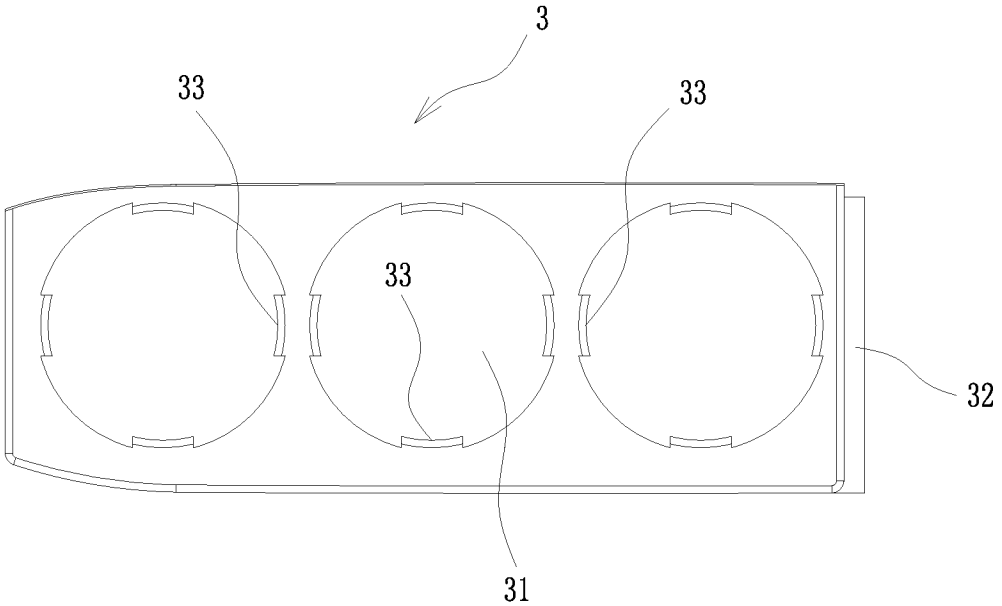
FIG. 5 is another schematic perspective view of the elastic soft block of the electronic cigarette case shown in FIG. 1.

Specifically, as shown in FIG. 4 and FIG. 5, the elastic soft block 3 defines a plurality of holding holes 31 configured to hold the electronic cigarettes 2. The holding holes 31 are through-holes, and the number of the holding holes 31 can be designed according to the number of electronic cigarettes 2 required to be accommodated in the electronic cigarette case. In this embodiment, each of the electronic cigarettes 2 can be disassembled into a structure including at least one battery pole 21 and at least one atomizer 22. Generally, each of the electronic cigarettes 2 includes one battery pole 21 and a plurality of atomizers 22. Correspondingly, the number of the elastic soft blocks 3 is two, and the two elastic soft blocks 3 are respectively configured to hold the at least one battery pole 21 and the at least one atomizer 22. Thus, the mounting positions of the two elastic soft blocks 3 correspond to the at least one battery pole 21 and the at least one atomizer 22, respectively.

In order to embed the electronic cigarette 2 in the holding hole 31 and hold the electronic cigarette 2 in the holding hole 31 firmly, in this embodiment, as shown in FIG. 4 and FIG. 5, at least one protruding resisting part 33 is formed on a portion of a surface of the elastic soft block 3 inside the holding hole 31. When one of the electronic cigarettes 2 is mounted inside the holding hole 31, the resisting part 33 and the electronic cigarette 2 resist each other. The resisting part 33 is substantially square, and extends from one end of the holding hole 31 to another end of the holding hole 31 along the axis of the holding hole 31. In this embodiment, the number of the resisting parts 33 is four, and the four resisting parts 33 are uniformly strewn on the portion of the surface of the elastic soft block 3 inside the holding hole 31. It is understood the shapes and the number of the resisting parts 33 can be changed, and can further be designed according to a shape and a size of the electronic cigarette 2.

In this embodiment, advantageously, the elastic soft block 3 is made of soft rubber or foam. Soft rubber is formed by plastic injection molding, feels soft at normal temperatures, and has good elasticity. Foam has good elasticity and low hardness, and further has advantages of convenience for use, bendable and thin structure, reliable performance, and so on. The elastic soft block 3 made of the soft rubber and the form can effectively avoid scratching the electronic cigarette 2.

Figure 3:
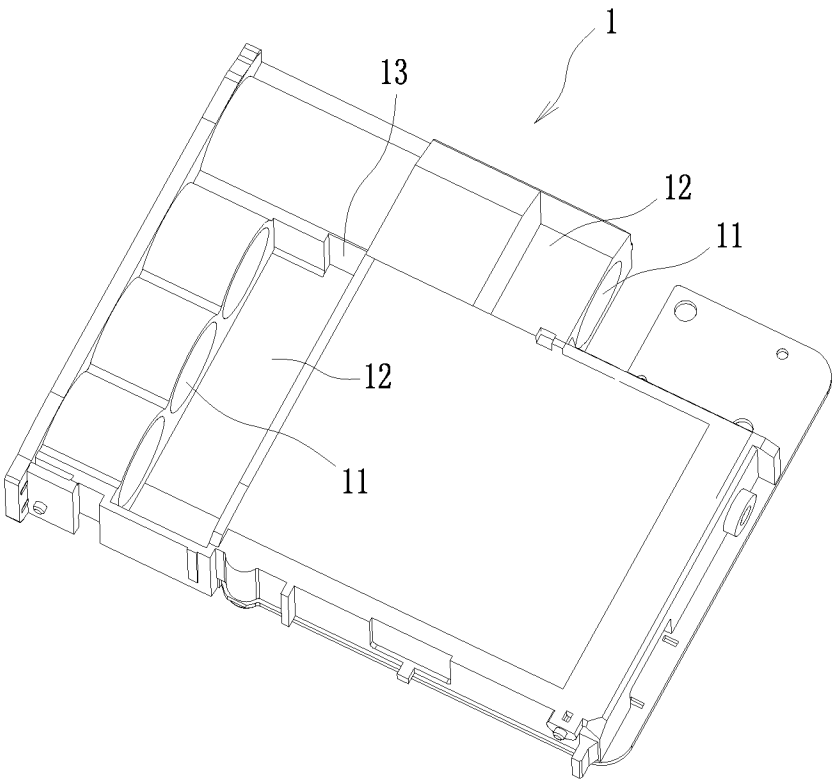
FIG. 3 is a schematic perspective view of a bracket of the electronic cigarette case shown in FIG. 1.

As shown in FIG. 3, the bracket 1 defines a plurality of accommodating holes 11 configured to accommodate the electronic cigarettes 2. The accommodating holes 11 are through-holes corresponding to the holding holes 31, and the number of the accommodating holes 11 can be designed according to the number of electronic cigarettes 2 required to be accommodated in the electronic cigarette case. The plurality of accommodating holes 11 are positioned on a side surface of the bracket 1, and each of the accommodating holes 11 is coaxial with a corresponding one of the holding holes 31. A diameter of each accommodating hole 11 is bigger than or equal to a diameter of a holding hole 31 corresponding to the accommodating hole 11, which facilitates the electronic cigarette 2 to pass through the accommodating hole 11 and be held in the holding hole 31. In order to fix the elastic soft block 3 on the bracket 1 firmly, the bracket 1 defines a mounting recess 12 matching the elastic soft block 3, and the elastic soft block 3 is mounted inside the mounting recess 12. A side surface of the elastic soft block 3 and a portion of a side surface of the bracket 1 inside the accommodating hole 11 that abuts a middle point of the bracket 1 resist each other.

In order to facilitate accurately fixing the elastic soft block 3 on an appropriate portion of the mounting recess 12, a protruding fool-proofing portion 32 is formed on a side surface of the elastic soft block 3, and a fool-proofing groove 13 matching the fool-proofing portion 32 is defined on an inner side wall of the mounting recess 12. A cut-away surface of the fool-proofing portion 32 is substantially square, correspondingly, a cut-away surface of the mounting recess 12 is also substantially square. It is understood that structures of the fool-proofing portion 32 and the mounting recess 12 are not limited in above-described structures, and can also be column structures.

In order to fix the elastic soft block 3 on the mounting recess 12 firmly, in the above-described embodiment of the present invention, various ways can be adopted to fix the elastic soft block 3 in the mounting recess 12. A first way is fastening connection. A first fastener (not shown) is formed on a side surface of the elastic soft block 3 abutting the mounting recess 12, and a first fastening slot (not shown) is formed in the mounting recess 12 and configured to fasten the first fastener. In another embodiment, a second fastening slot (not shown) is formed on a side surface of the elastic soft block 3 abutting the mounting recess 12, and a second fastener (not shown) is formed in the mounting recess 12 and configured to be fastened by the second fastening slot. In this electronic cigarette case, the connection between the elastic soft block 3 and the mounting recess 12 by fastening has advantages of convenience for detaching, reliable connection, and so on. A second way is adhesion. An adhesive layer (not shown) is positioned between the elastic soft block 3 and the mounting recess 12, and configured to adhere the elastic soft block 3 to the mounting recess 12. The adhesive layer can be made of glue, double-sided adhesive, resin glue, and so on. In this electronic cigarette case, the adhesion connection between the elastic soft block 3 and the mounting recess 12 enables the elastic soft block 3 to be fixed on the mounting recess 12 firmly.

In another embodiment of the present invention, the elastic soft block 3 is integrated with the bracket 1. The integrated structure including the elastic soft block 3 and the bracket 1 has higher massive structural strength and better visual effect.

In the above-described embodiments of the present invention, the electronic cigarette case further includes a first case body 4 and a second case body 5 connected with the first case body 4. The bracket 1 is mounted inside space formed by the first case body 4 and the second case body 5. The first case body 4 is connected with the second case body 5 by hinging. It is understood that the first case body 4 can connected with the second case body 5 by other connecting structures, such as detachable fastening connecting structure and so on.

While the embodiments of the present invention are described with reference to the accompanying drawings above, the present invention is not limited to the above-mentioned specific implementations. In fact, the above-mentioned specific implementations are intended to be exemplary not to be limiting. In the inspiration of the present invention, those ordinary skills in the art can also make many modifications without breaking away from the subject of the present invention and the protection scope of the claims. All these modifications belong to the protection of the present invention.

What is claimed is:

1. An electronic cigarette case comprising a case body configured to accommodate electronic cigarettes, a case lid connected with the case body, a bracket mounted inside space formed by the case body and the case lid and configured to space each of the electronic cigarettes, and two elastic soft blocks mounted in the bracket and configured for holding the electronic cigarettes;

wherein the bracket is divided into a left portion and a right portion;

at least one spaced through-hole and a first mounting recess arranged below the at least one spaced through-hole are defined in the right portion, a first elastic soft block is fully received in the first mounting recess, and at least one holding through-hole aligned with the at least one spaced through-hole respectively is defined in the first elastic soft block;

a plurality of spaced through-holes, a second mounting recess configured to mount a second elastic soft block, and a third mounting recess are defined in the left portion from top to bottom, the second elastic soft block is fully received in the second mounting recess, and a plurality of holding through-holes aligned with the pluralities of spaced through-holes respectively are defined in the second elastic soft block;

a top of the right portion is level with that of the left portion and a bottom of the right portion extends to a level below the second mounting recess;

at least one protruding resisting part is formed on an inner surface of each of the holding through-holes, the resisting part extends from one end of each of the holding through-holes to the other end of each of the holding through-holes along an axis of each of the holding through holes, and the resisting part and each of the electronic cigarettes resist each other.

2. The electronic cigarette case according to claim 1, wherein, the number of the at least one resisting parts provided is four, and the four resisting parts are uniformly strewn on the inner surface of each of the the holding through-holes.

3. The electronic cigarette case according to claim 1, wherein, the two elastic soft blocks are made of soft rubber or foam.

4. The electronic cigarette case according to claim 1, wherein, the spaced through-holes are configured to correspond to the holding through-holes, and each of the spaced through-holes is coaxial with a corresponding one of the holding through-holes.

5. The electronic cigarette case according to claim 1, wherein, each of the elastic soft blocks further includes a protruding fool-proofing portion formed on a side surface of each of the elastic soft blocks, and a fool-proofing groove matching the fool-proofing portion is defined on an inner side wall of each of the first and second mounting recesses.

6. The electronic cigarette case according to claim 1, wherein, a first fastener is formed on a side surface of each of the elastic soft blocks abutting the first or second mounting recess, and a first fastening slot is formed in each of the first and second mounting recesses and configured to fasten the first fastener.

7. The electronic cigarette case according to claim 1, wherein, a second fastening slot is formed on a side surface of each of the elastic soft blocks abutting the first or second mounting recess, and a second fastener is formed in each of the first and second mounting recesses and configured to be fastened by the second fastening slot.

8. The electronic cigarette case according to claim 1, wherein, an adhesive layer is positioned between the first elastic soft block and the first mounting recess, and between the second elastic soft block and the second mounting recess.

9. The electronic cigarette case according to claim 1, wherein, the elastic soft blocks are integrated with the bracket.

10. The electronic cigarette case according to claim 1, wherein, the case body is connected with the case lid by hinging.

* * * * *